US006312253B1

(12) United States Patent
Fons et al.

(10) Patent No.: US 6,312,253 B1
(45) Date of Patent: Nov. 6, 2001

(54) COOLER FOR PARTICULATE MATERIAL

(75) Inventors: Mogens Juhl Fons, Hadsund (DK); Flemming Schomburg, Bethlehem, PA (US)

(73) Assignee: Smidth & Co. A/S, Valby Copenhagen (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/403,118

(22) PCT Filed: Apr. 7, 1998

(86) PCT No.: PCT/EP98/02012

§ 371 Date: Oct. 14, 1999

§ 102(e) Date: Oct. 14, 1999

(87) PCT Pub. No.: WO98/48231

PCT Pub. Date: Oct. 29, 1998

(30) Foreign Application Priority Data

Apr. 22, 1997 (DK) ..... 0447/97

(51) Int. Cl.[7] ..... F27D 15/02
(52) U.S. Cl. ..... 432/78; 110/281
(58) Field of Search ..... 432/77, 78; 110/268, 110/281; 126/163 R, 167

(56) References Cited

U.S. PATENT DOCUMENTS 2,904,323 * 9/1959 Cova et al. ..... 432/58
3,010,218 * 11/1961 Sylvest ..... 34/164
5,895,213 * 4/1999 Sutoh et al. ..... 432/77

FOREIGN PATENT DOCUMENTS

0718578A * 6/1996 (EP) .
97/07881A * 3/1997 (WO) .

OTHER PUBLICATIONS

"Grate Cooler", Research Disclosure, No. 386, p. 339 XP 000596150, Jun. 1996.*

* cited by examiner

*Primary Examiner*—Jiping Lu
(74) *Attorney, Agent, or Firm*—Baker Botts, L.L.P.

(57) ABSTRACT

A cooler for cooling particulate material which has been subjected to heat treatment in an industrial kiln, such as a rotary kiln for manufacturing cement clinker, which cooler comprises an inlet, an outlet, end walls, side walls, a bottom and a ceiling, at least one stationary supporting surface for receiving and supporting the material to be cooled, means for injecting cooling gas into the material, as well as a reciprocating scraper system which comprises a number of rows of scraper elements arranged transversely across the direction of movement of the material, said scraper elements being moved back and forth in the direction of movement of the material for conveying the material forward across the supporting surface. The cooler is peculiar in that each of the transverse scraper elements is firmly fixed to at least one drive plate oriented in the direction of movement of the material, said plate extending at least across the entire length of the supporting surface, and being led either through the supporting surface of the cooler, its ceiling, one of its side walls and/or at least one of its end walls, where the drive plate is connected to a drive arrangement for movement back and forth.

68 Claims, 5 Drawing Sheets

COOLER FOR PARTICULATE MATERIAL

BACKGROUND OF THE INVENTION

The present invention relates to a cooler for cooling particulate material which has been subjected to heat treatment in an industrial kiln, such as a rotary kiln for manufacturing cement clinker, which cooler comprises an inlet, an outlet, end walls, side walls, a bottom and a ceiling, at least one stationary supporting surface for receiving and supporting the material to be cooled, means for injecting cooling gas into the material, as well as a reciprocating scraper system which comprises a number of rows of scraper elements which extend transversely across the direction of movement of the material, said elements being moved back and forth in the direction of movement of the material in order to convey the material forward over the supporting surface.

In EP 0718578 a cooler of the aforementioned kind is described. In this known cooler, the scraper elements are made up of cross bars with a triangular cross-sectional profile, with the bars being mutually connected via chains and being moved back and forth on the supporting surface by means of chain wheels fitted at the ends of the supporting surface. This known cooler has several drawbacks. Because of the high temperatures which occur in the cooler, and particularly at the inlet end of the cooler, as well as the substantial forces which are required to convey the material through the cooler, the chains must be designed with relatively large dimensions. As a result, the chains will form so-called shadow areas of equivalent size, i.e. areas in which the chains obstruct the upward-flowing cooling gas so that the overlying material is not cooled as intended. Also, the cross bars in the known cooler are not firmly fixed to restrain them from moving, neither perpendicularly to the material's direction of movement nor in terms of rotation about their own longitudinal axis. In cases where a larger body of material is to be conveyed through the cooler, one or several cross bars may therefore be forced vertically upwards, and may come to ride on the body. This will reduce the conveyance of material through the cooler. In cases where a cross bar is lifted at one side only, the cross bar will also be able to move towards one side of the cooler, thereby giving rise to operational disorders. Rotation of one or several of the cross bars may have an adverse effect on the efficiency of conveyance. Furthermore, the known cooler is vulnerable to operational disorders, for example in event of rupture of a single chain link, given the necessity to shut down the cooler in order to undertake the necessary repair work. A further disadvantage of the known cooler is that the driving system in the form of the chains consists of wear parts which must be replaced at regular intervals.

SUMMARY OF THE INVENTION

The purpose of the present invention is to provide a cooler by means of which the aforementioned disadvantages are eliminated.

This is achieved by means of a cooler of the kind mentioned in the introduction, and being characterized in that each row of the transverse scraper elements is firmly fixed to at least one drive plate oriented in the direction of movement of the material, and in that said drive plate extends at least across the entire length of the supporting surface, and in that said drive plate is led either through the supporting surface, the ceiling, one of the side walls and/or at least one of the end walls of the cooler, where the drive plate is connected to a drive arrangement for movement back and forth.

Hereby is obtained a better and more uniform cooling of the material in the cooler, a better and safer conveyance of the material through the cooler, a higher degree of operational reliability and a reduction of the wear to which the drive elements are exposed. The cooling of the material is improved due to the fact that the drive system can be designed with smaller dimensions, thereby reducing the attendant shadow area. Among other things, this is ascribable to the fact that the drive plate, because it extends across the entire length of the supporting surface, will always be moving along its own track, which means that it shall never push away material being deposited in front of it. Also, as is the case for the known chain option, there will not be accumulated a chain force throughout the cooler. The conveyance of material through the cooler is improved due to the scraper elements being firmly fixed to the drive plate. As a result, the scraper elements will neither be able to move perpendicularly relative to the material's direction of movement nor will they be rotatable about their own centre axis. The cooler attains a higher degree of operational reliability in that, essentially, only the scraper elements proper are exposed to wear. Should a single scraper element break, cooler operation may be continued without any appreciable problems until next shutdown for maintenance is scheduled to take place. The drive plate is only subjected to minimum wear due to the fact that, as previously noted, it moves back and forth along its own track.

As previously mentioned, the drive plate may either be led through the supporting surface of the cooler, its ceiling, one of its side walls and/or at least one of its end walls. In cases where the drive plate is led through the supporting surface, it is preferred that the drive plate is substantially vertical, and that at all times over a part of its length, equivalent to the length of the supporting surface, it extends at least down into a slot which is provided throughout the length of the supporting surface, and, furthermore, that over at least parts of its length it extends down through the slot to an underlying chamber in which the drive plate is connected to a drive arrangement for movement back and forth.

In order to protect the drive plate and to shield the supporting surface against drop-through of material, the cooler may be designed so that at both sides of the drive plate it comprises a wall element which is fixed to the supporting surface, with said wall elements extending over the entire length of the supporting surface and protruding slightly less into the cooler than the drive plate, and so that on the upper side of the drive plate and over its entire length a plate element is fitted which is designed so that it extends over and beyond the upper side edge of the wall elements. Hence the drive plate and the slot in which the latter is guided is effectively shielded against the material in the cooler, thereby minimizing the wear on the drive plate and effectively restraining the material from gaining access to the slot in the supporting surface. In such an embodiment it is only the plate element fitted on the drive plate which moves back and forth in the material, and it is doing so along its own track, so the wear on said plate is insignificant.

To minimize the torsional forces which the drive plate must be able to absorb, and thus to reduce the necessary dimensions of the drive plate, it is preferred that each row of transverse scraper elements is fixed to at least two substantially parallel drive plates.

The drive arrangement, which supports and drives the drive plate or plates in the compartment under the supporting surface, may comprise a drive frame which is preferably made up of two longitudinal girders and at least two transverse girders. The transverse girders may be designed as stiffening braces to enhance the rigidity of the drive frame. In the preferred embodiment where each row of transverse scraper elements is fixed to two drive plates, the drive plates are fixed to the longitudinal girders. Each of the longitudinal girders of the drive frame is movably supported at least at two locations by means of rails fixed to the underside of the longitudinal girders, said rails sliding in bearings, preferably linear roller or ball bearings, which are fixed to the machine frame at an appropriate distance. It is preferred that the drive frame is supported by two bearings for each longitudinal girder. In principle, the drive frame may be driven back and forth by using any means appropriate for the purpose, but it is preferred that the drive frame be driven by means of one or several hydraulic cylinders which are connected to the cross girders of the drive frame.

In cases where the cooler comprises two or more rows of scraper elements transversely across the cooler, it is preferred that each row be driven separately. Hence the velocity as well as the stroke length by which the single rows are moved back and forth may be varied independently for each row so that a desirable pattern of movement of the material through the cooler can be obtained.

The scraper elements may be firmly fixed to the drive plate or plates in any suitable manner, but for reasons of maintenance it is preferred that fixation is done by mechanical means. The fastening means may be configured in a variety of manners, and may in what is probably the simplest configuration consist of bolts which via drilled holes in the scraper elements are screwed down into the drive plate. In a similar simple configuration, the fastening means may consist of angle irons being fixed by means of bolts to drive plate as well as scraper element. Given that the thermal loading and the wear exposure of the fastening means may be quite substantial, it would be advantageous if the fastening means is configured with due attention being given to the these factors. Therefore, it is preferred that each scraper element is fixed to the upper side of each drive plate by means of a substantially box-like element which, at its side facing the drive plate, comprises a cut-out section which may be complementary to the cross-sectional profile of the scraper element. On each side of the cut-out section the box element is configured with an at least downward terminating cavity for accommodating the from the drive plate upwardly protruding ears which are provided with a through-going hole which during the mounting of the box element is situated on line with a corresponding hole provided in the box element. In connection with the mounting of the element, a wedge is knocked through the holes on both sides of the scraper element, thereby restraining the box element and thus the scraper element against the drive plate. Subsequently, each wedge may be locked by means of a locking pin which is knocked into a hole subsequently drilled at least through the relevant ear and the wedge. The scraper element may further be restrained from axial movement by means of a pin or pawl, which is inserted in a hole in the scraper element and extending up through a hole in the upward-turning side of the scraper element. To allow a minor axial movement of the scraper element, for example in case of thermal dimensional changes, the size of the hole in the upward-facing side of the box element may slightly exceed the size of the pin or pawl. This will allow the scraper element to move freely in its longitudinal direction. In cases where the scraper element is mounted on two or more drive plates, it is preferred that a pin or pawl is only fitted at one of the drive plates so that the scraper element is freely held to allow axial dimensional changes of at the other or the others point(s) of fixation.

In order to satisfy the requirement that each drive plate at all times across the entire length of the supporting surface extends down into its respective slot, the drive plate must be configured with a length which corresponds at least to the length of the supporting surface plus the selected stroke length of the drive plate. In cases where the supporting surface at the inlet end of the cooler is situated closely up against the end wall of the cooler, it will, therefore, be necessary to lead the drive plate through an opening provided in the end wall of the cooler. The opening may preferably be configured so that it corresponds exactly to the cross-sectional profile of the drive plate and the plate element lying thereon. To capture the dust accompanying the drive plate through the opening, a pressurized box may be fitted to the outer side of the cooler, with the depth of said box corresponding at least to the selected stroke length of the drive plate.

In an alternative embodiment the drive plate may be led through the side wall of the cooler. In this case it is preferred that the drive plate is substantially horizontal, and that it extends at all times over a part of its length, equivalent to the length of the supporting surface, at least into a slot provided in one of the side walls of the cooler, which slot has a length which corresponds at least to the length of the supporting surface, and, furthermore, that over at least parts of its length it extends further out through the slot to the surrounding environment where the drive plate is connected to a drive arrangement for movement back and forth.

It is preferred that the cooler in this embodiment is provided with a drive plate at both sides.

For absorbing potential thermal expansion, the drive plates may be provided with slits provided at appropriate intervals.

The scraper elements may consist of bars having a substantially triangular cross-sectional profile, preferably a right angled triangular profile, the forward-facing pushing surface of which being steeper than its backward-facing sliding surface, and its downward-facing surface being substantially horizontal. The forward-facing surface is typically configured so that it extends at an angle $\alpha$ of between 60 and 90° relative to horizontal, whereas the backward-facing surface is typically configured so that it extends at an angle $\beta$ of between 20 and 40° relative to horizontal. The lowermost part of the backward-facing sliding surface may be configured steeper than the rest of the sliding surface in order to reduce the sharpness of the backward-facing side edge, thereby enhancing the wear-resistant characteristics.

In addition to the movable scraper elements, the cooler may also comprise stationary scraper elements which are preferably fixed to longitudinal girders fitted at the sides of the supporting sides. In a particular embodiment of the cooler according to the invention, every second scraper element is stationary. The movable and the stationary scraper elements may be differently configured with a view to obtaining a desirable pattern of conveyance of the material in the cooler.

For operational reasons, which specifically relate to the efficiency of the cooler, it may be advantageous to minimize at the inlet end of the cooler the movement of the material in the longitudinal direction of the cooler. Such a so-called stationary inlet may, for example, be obtained by configuring the cooler without scraper elements in the inlet end. In case agitation of the material is desired at the inlet end, the cooler may be configured with, for example, scraper elements which are pointing in opposite direction at the inlet end, with equal-sided scraper elements at the inlet end or with alternative geometries providing a desirable pattern of conveyance.

Each of the stationary supporting surfaces may in a preferred embodiment consist of a grate which is made up of a number of grate plates, each of which being provided with through-going slits or holes for injecting cooling gas through the material from the underlying compartment. Such an arrangement is disclosed in WO 94/08191 and WO 94/08192, which are incorporated herein by reference. The stationary supporting surfaces in an alternative embodiment may consist of a number of trays which are designed as a rectangular box with bottom, side walls and end walls, and containing, during operation, a quantity of the particulate material which is to be cooled, and incorporating at the bottom of each tray a number of gas supply means for injecting cooling gas into the material. Such an arrangement is disclosed in WO 94/15161, which is incorporated herein by reference.

In cases where the supporting surface consists of a grate or trays, it is preferred that the gas supply to each grate plate or tray by means of flow regulators fitted in the gas supply duct of each grate plate or tray is regulated continuously and automatically in direct response to the gas flow condition in and above the relevant grate plate or tray. Such an arrangement is described in our WO 97/07881, which is incorporated herein by reference.

BRIEF DESCRIPTION OF THE DRAWINGS

The invention will now be described in further details with reference to the drawing, being diagrammatical, and where.

DESCRIPTION OF THE PREFERRED EMBODIMENTS

Figure 1:
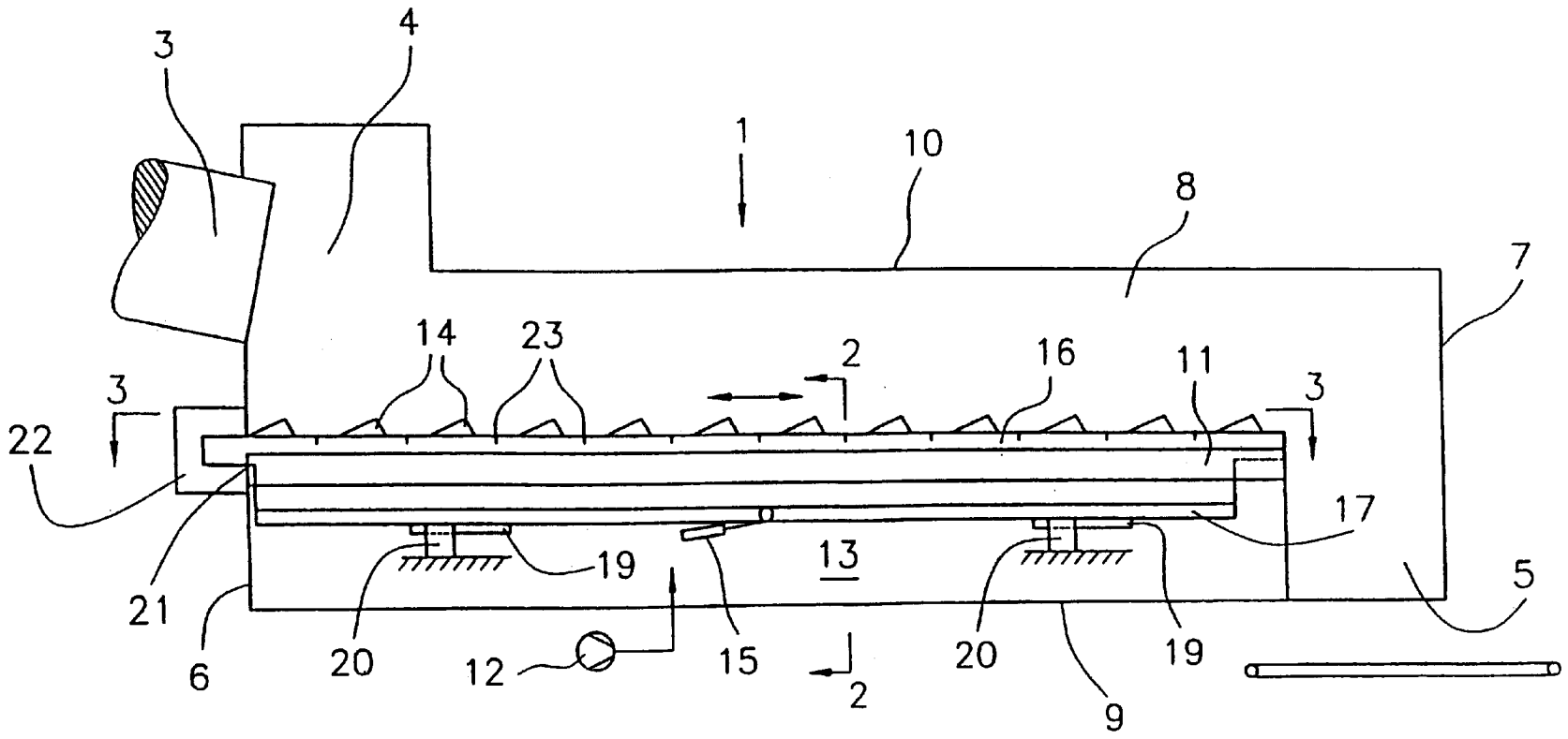
FIG. 1 shows a longitudinal section of a first embodiment of the cooler according to the invention.
Figure 2:
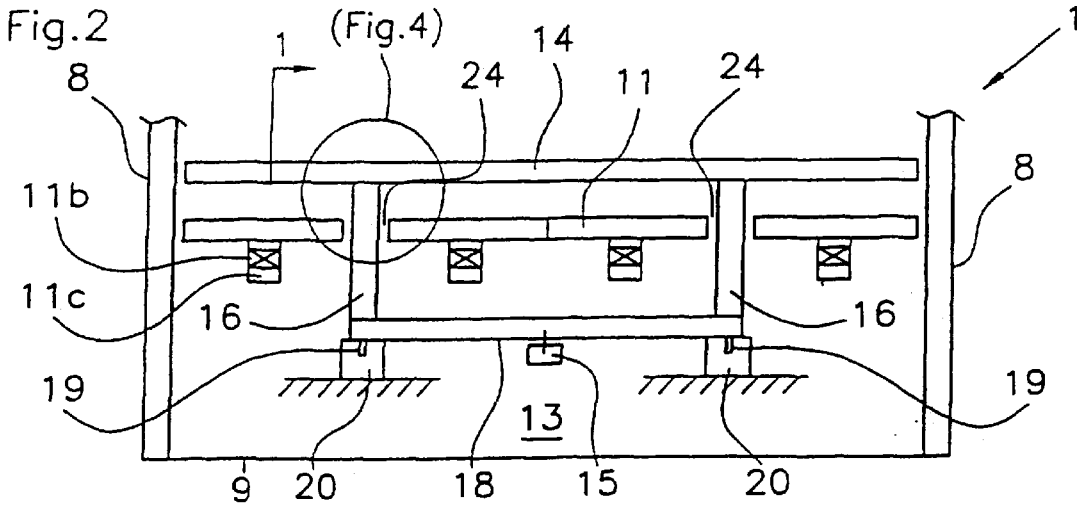
FIG. 2 shows a cross-section taken on the line 2—2 in FIG. 1.
Figure 3:
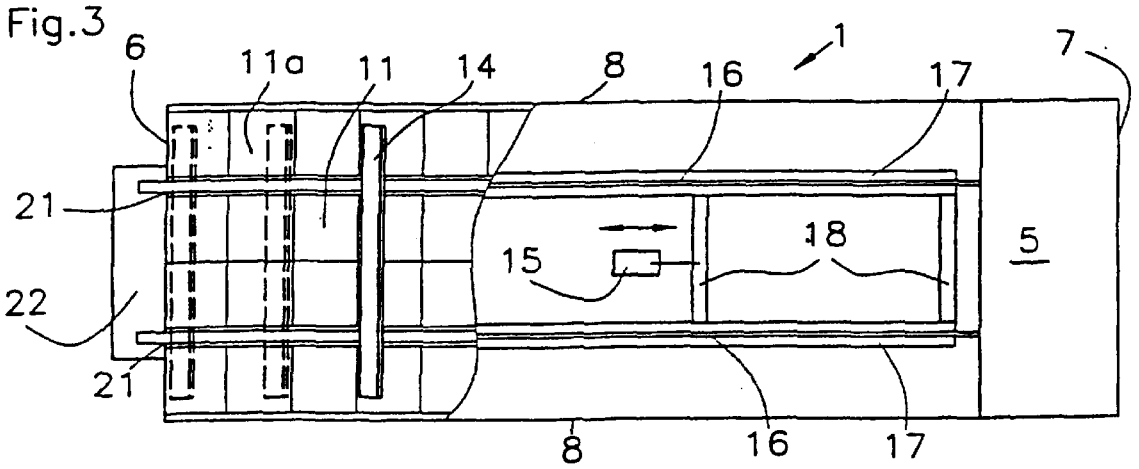
FIG. 3 shows a top view as seen from the line 3—3 in FIG. 1 with parts partially cut away.

In FIGS. 1, 2 and 3 is seen a cooler 1 which is placed in direct extension of a rotary kiln 3 for manufacturing cement clinker. The cooler comprises an inlet 4, an outlet 5, end walls 6, 7, side walls 8, a bottom 9 and a ceiling 10. The cooler shown also comprises a stationary grate bottom 11 which is made up of a number of grate plates 11*a* for supporting the cement clinker, a fan 12 for injecting cooling gas up through the clinker via a compartment 13 and the grate bottom 11, as well as a row of scraper elements 14 which can be moved back and forth in the longitudinal direction of the cooler by a driving means 15, so that the clinker is conveyed from the inlet end of the cooler to its outlet end. The cooler may be configured with several parallel-positioned rows of scraper elements 14. If so, it is preferred that each row is driven by separate driving means.

The shown cooler further comprises continuously and automatically operating flow regulators 11*b* which are fitted in the gas supply duct 11*c* of each grate plate 11*a* for regulating the cooling gas flow up through the grate plate in question.

In the shown embodiment the scraper elements are mounted on two vertically positioned drive plates 16 which extend down through slots 24 provided in the grate bottom 11, and being supported by a frame structure which is made up of two longitudinal girders 17 and a number of cross girders 18. The frame structure is movably supported by means of rails 19 fixed to the lower side of the longitudinal girders 17 and linear ball bearings 20 which are fixed to the frame of the machine. It is preferred that the frame structure is supported by exactly two bearings for each longitudinal girder because the system thereby does not become statically undetermined. This will prevent build-up of internal stresses resulting, for example, from deformations which would subject the bearings to unnecessary stress loading.

The drive plates 16 are configured with a length which corresponds to the length of the grate bottom 11 itself plus the stroke length of the drive plates. In FIGS. 1 and 3 the drive plates are shown in their fully retracted position where each of the plates protrudes through an opening 21 provided in the inlet end wall 6 of the cooler. The opening is designed so that it corresponds exactly to the cross-sectional profile of the drive plate and the plate element placed thereon. In order to capture dust which is conducted through the openings 21, a pressurized box 22 through which the collected dust is returned to the cooler is fitted at the outer side of the cooler. The box 22 is pressurized by means of air from the compartment 13 or from an external air supply source, such as a fan or a compressor. The openings 21 may be individually sealed by means of a sliding seal which is configured complementary to the plate element placed on the drive plate, and riding thereon.

In connection with the maintenance work, the drive plates may be pulled out through the end wall 6 or pulled vertically up through the grate bottom.

As shown in FIG. 1 the drive plates are formed with slits 23 for absorbing a potential thermal expansion in the uppermost part of the drive plate to prevent arching of the drive plate.

Figure 4:
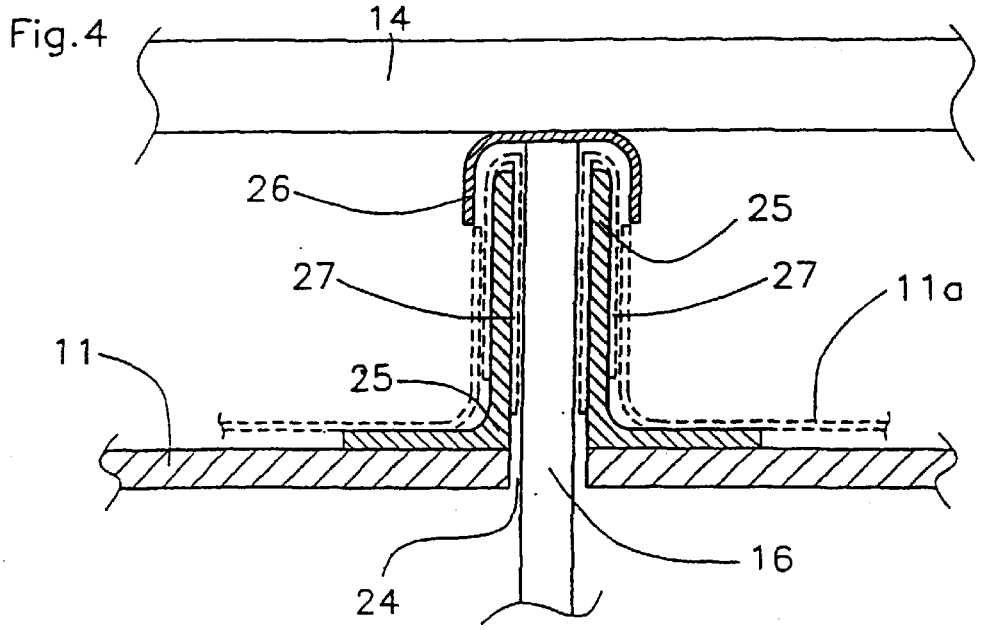
FIG. 4 shows a first sectional detail of a sealing arrangement.

In FIG. 4 is shown an example of how the grate surface 11 can be advantageously shielded against fall-through of material while, at the same time, the drive plate 16 is protected against wear exposure from the material in the cooler. In the shown example the sealing arrangement comprises two angular wall elements 25 being fixed on either side of the drive plate to the grate bottom 11 and a plate element 26 which is configured as an inverted U and which is mounted on the upper side of the drive plate where it is retained i.a. by means of the scraper elements 14. In the longitudinal direction of the cooler the wall elements have the same length as the grate surface 11, whereas the plate element 26 has the same length as the drive plate. As shown in dotted lines in FIG. 4, the sealing arrangement may further comprise two wear caps 27 which are inserted over separate wall elements 25. The position of the grate plates 11*a* relative to the sealing arrangement is also shown in dotted lines.

Figure 5A:
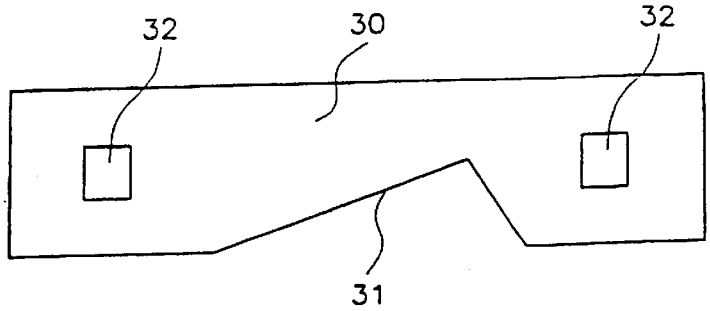
FIGS. 5*a* to 5*e* show details of a scraper mounting.
Figure 5B:
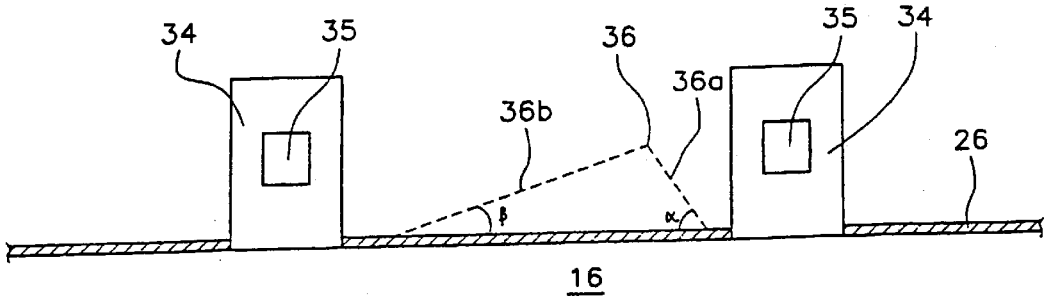
Figure 5C:
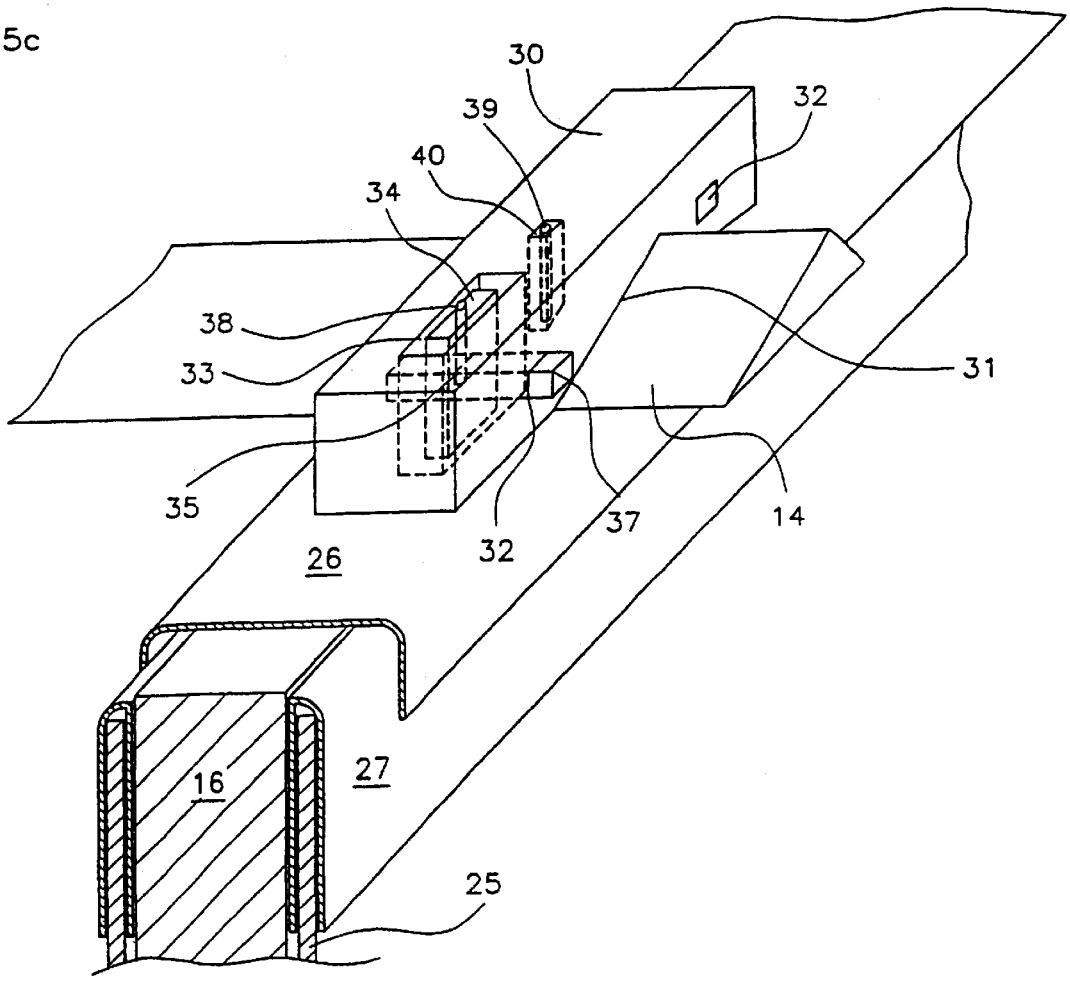

FIGS. 5*a*, 5*b* and 5*c* show an example of how the scraper elements 14 can be firmly fixed on a drive plate 16. In the shown example, fixation is done by means of a block 30 as shown in FIG. 5*a* which is formed with a recessed section 31 for accommodating the scraper element, and with two through-going holes 32. As shown in FIG. 5*b*, the drive plate 16 is formed with ears 34 which protrude upwards through cut-out sections in the plate element 26, each being formed with a through-going hole 35. The position of the scraper element 14 is shown in dotted lines 36. At stage of mounting, the scraper element 14 is mounted as shown in FIG. 5*c* on the plate element 26 between two ears 34, whereafter the block is placed on top so that the ears 34, as indicated at the left side of the block, protrude up through the cavities 33 provided in the block, the scraper element extends through the cut-out section 31, and the holes 32 in the block are on line with the holes 35 in the ears 34. A wedge 37 is then knocked through the holes 32, 35 on both sides of the scraper element 14. The wedges 37 are locked by means of locking pins 38, each of which extends through the ear 34 and into the wedge 37. The scraper element 14 is retained by means of a pawl 39 which is mounted in the scraper element 14, extending up through a hole 40 provided in the block 30.

Figure 5D:
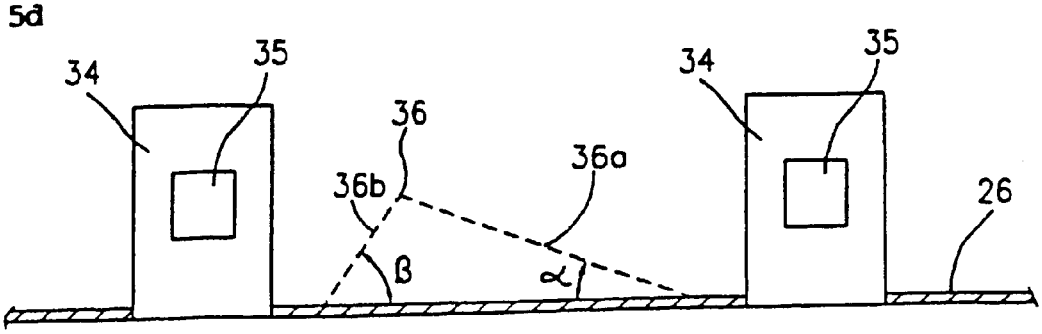
Figure 5E:
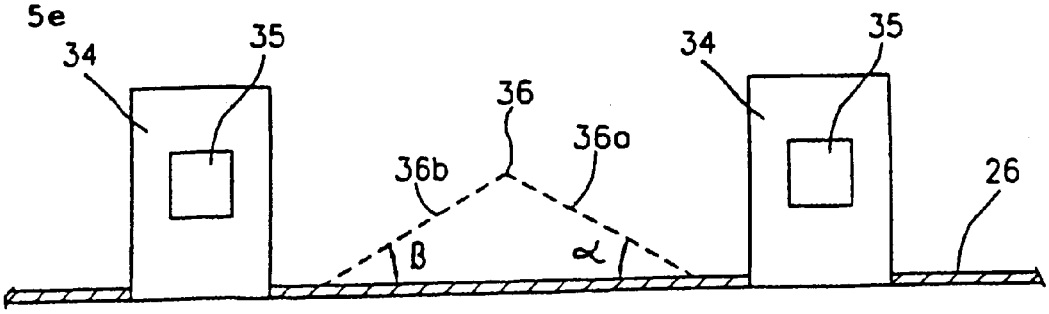

As it appears from FIGS. 5*b* and 5*c*, the scraper elements are made up of bars with a right angled triangular profile in section, the forward-facing pushing surface 36*a* of which being steeper than its backward-facing sliding surface 36*b*, and the downward-facing surface of which being substantially horizontal. The forward-facing surface extends at an angle $\alpha$ of between 60 and 90° relative to the horizontal, whereas the backward-facing surface extends at an angle $\beta$, of between 20 and 40° relative to the horizontal. The lowermost part of the backward-facing sliding surface may be configured so that it is steeper than the rest of the sliding surface in order to reduce the sharpness of the backward-facing side edge, thereby enhancing the wear-resistant characteristics. Alternatively at least some of the scraper elements may have their steeper face facing rearwardly, as shown in FIG. 5*d*; or be of isosceles triangle sectional shape, as shown in FIG. 5*e*.

Figure 6:
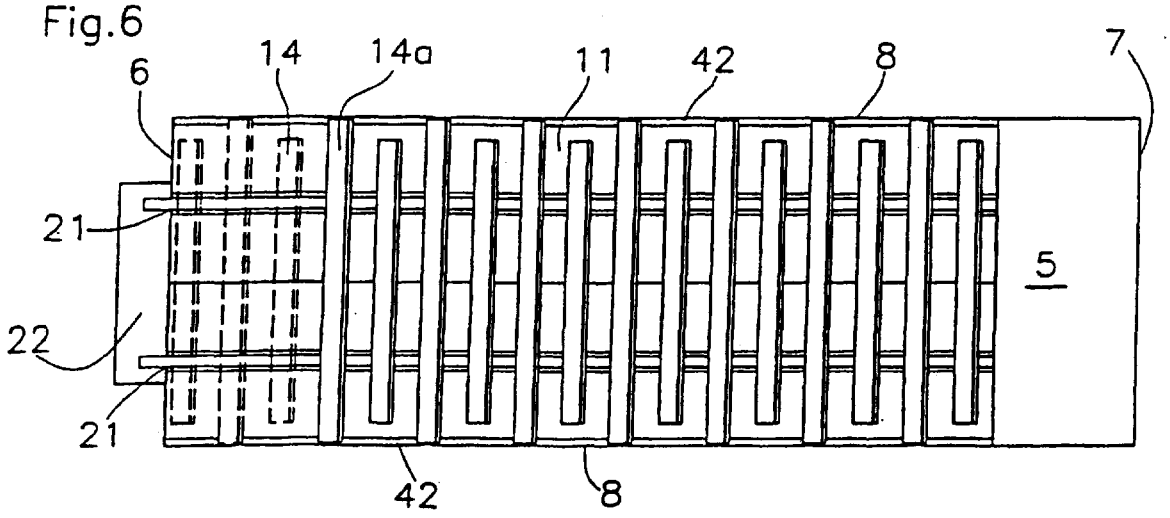
FIG. 6 shows in plan a second embodiment of cooler.

In FIG. 6 is seen a cooler which, in addition to the movable scraper elements 14, also contains stationary scraper elements 14*a* which are fixed to longitudinal girders 42 fitted at the sides of the supporting surface 11. In the shown embodiment every second scraper element is stationary. Some of the scraper elements may be omitted at the inlet end as shown by the dashed line outline of the elements 14 and 14*a* in FIGS. 3 and 6.

Figure 7:
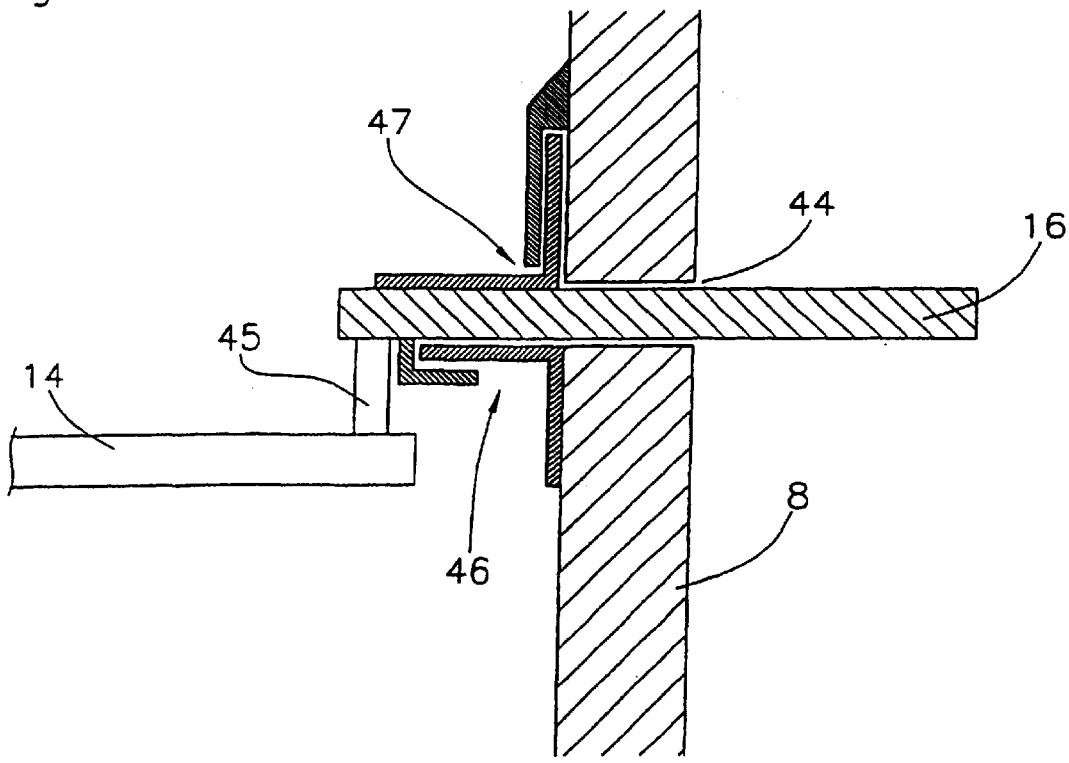
FIG. 7 shows a sectional detail of another embodiment.

In FIG. 7 is seen an example of how a drive plate 16 can instead be led through a slot 44 provided in the side wall 8 of the cooler. In the shown embodiment, the scraper element 14 is mounted on the drive plate 16 via a spacer 45 which provides the necessary space for mounting sealing means 46. Also fitted above the drive plate 16 are sealing means 47 for minimizing the leakage of dust and cooling gas from the cooler.

What is claimed is:

1. A cooler, for cooling particulate material which has been subjected to heat treatment in an industrial kiln, which cooler comprises an inlet, an outlet, end walls, side walls, a bottom and a ceiling, at least one stationary supporting surface for receiving and supporting the material to be cooled, means for injecting cooling gas into the material, as well as a reciprocating scraper system which comprises at east one row of scraper elements which extend transversely across the direction of movement of the material, said elements being moved back and forth over the supporting surface in the direction of movement of the material in order to convey the material forward over the supporting surface, CHARACTERIZED IN THAT each row of the transverse scraper elements is firmly fixed to at least one drive plate oriented in the direction of movement of the material, and in that said plate extends at least across the entire length of the supporting surface, and in that said drive plate extends either through the supporting surface, the ceiling, one of the side walls and/or at least one of the end walls of the cooler, where the drive plate is connected to a drive arrangement for movement back and forth.

2. A cooler (1) according to claim 1, CHARACTERIZED IN THAT the drive plate (16) is substantially vertical, and in that at all times over a part of its length, corresponding to the length of the supporting surface (11), it extends at least down into a slot (24) which is provided throughout the length of the supporting surface, and in that further over at least parts of its length it extends down through the slot (24) to an underlying chamber (13) in which the drive plate is connected to a drive arrangement for movement back and forth.

3. A cooler (1) according to claim 2, CHARACTERIZED IN THAT at both sides of the drive plate (16) there is a wall element (25) which is fixed to the supporting surface (11), and in that extending over the entire length of the supporting surface it protrudes slightly less into the cooler than the drive plate (16), and in that on the upper side of the drive plate and over its entire length a plate element (26) is fitted with said element being designed so that it extends over and beyond the upper side edge of the wall elements.

4. A cooler (1) according to claim 2, CHARACTERIZED IN THAT each row of transverse scraper elements (14) is fixed to at least two substantially parallel drive plates (16).

5. A cooler (1) according to claim 4, CHARACTERIZED IN THAT the drive arrangement comprises a drive frame which is made up of two longitudinal girders (17) and at least two transverse girders (16) and in that the drive plates (16) are fixed to the longitudinal girders (17).

6. A cooler according to claim 5, CHARACTERIZED IN THAT each of the longitudinal girders (17) of the drive frame is movably supported at least at two locations by means of rails (19) fixed to the underside of the longitudinal girders (17), and in that said rails slide in bearings (20), which are fixed to the machine frame at an appropriate distance.

7. A cooler (1) according to claim 6, CHARACTERIZED IN THAT said cooler comprises at least one hydraulic cylinder (15) for moving the drive frame back and forth, said hydraulic cylinder being connected to one of the transverse girders of the drive frame.

8. A cooler (1) according to claim 7, CHARACTERIZED IN THAT said cooler comprises for each row of scraper elements (14) at least one hydraulic cylinder, and in that the hydraulic cylinders can be separately operated.

9. A cooler according to claim 4, characterized in that each scraper element is fixed to the upper side of each drive plate by means of a vox-like element which at its side facing the drive plate comprises a cutout section for accommodating the scraper element, and in that on each side of the cut-out section it is formed with an at least downward terminating cavity for accommodating the from the upper side of the drive plate upwardly protruding ears which are provided with a through-going hole which during the mounting of the box element is situated on line with a corresponding hole provided in the box element, and in that a wedge is fitted so that it extends through the holes on both sides of the scraper clement, and in that each wedge is locked by means of a locking pin which extends at least through the relevant ear and wedge, and in that the scraper element is further restrained in axial direction by means of a pawl which is inserted in the scraper element extending least through a hole in the upward-turning side of the box element.

10. A cooler (1) according to claim 2, CHARACTERIZED IN THAT each scraper element (14) is fixed to the upper side of each drive plate (16) by means of a box-like element (30) which at its side facing the drive plate (16) comprises a cutout section (31) for accommodating the scraper element, and in that on each side of the cut-out section it is formed with an at least downward terminating cavity (33) for accommodating from the upper side of the drive plate upwardly protruding ears (34) which are provided with a through-going hole (35) which during the mounting of the box clement is situated on line with a corresponding hole (32) provided in the box element, and in that a wedge (37) is fitted so that it extends through the holes (32, 35) on both sides of the scraper element, and in that each wedge (37) is locked by means of a locking pin (38) which extends at least through the relevant ear and wedge, and in that the scraper clement is further restrained in axial direction by means of a pawl (39) which is inserted in the scraper element extending up through a hole (40) in the upward-turning side of the box clement.

11. A cooler (1) according to any one of claims 1–9 or 22 claims, CHARACTERIZED IN THAT each drive plate (16) has a length which corresponds at least to the length of the supporting surface (11) plus a selected stroke length of the drive plate.

12. A cooler (1) according to claim 11, CHARACTERIZED IN THAT each drive plate (16) extends through an opening (21) provided in the end wall (6) of the cooler, which opening (21) is configured so that it corresponds exactly to the cross-sectional profile of the drive plate (16) and the plate element (26) lying thereon, and in that a pressurized box (22) is fitted on the outer side of the cooler, with the depth of the box corresponding at least to the selected stroke length of the drive plate.

13. A cooler (1) according to claim 1, CHARACTERIZED IN THAT said cooler drive plate (16) is substantially horizontal, and in that at all times over a part of its length, corresponding to the length of the supporting surface (11), the plate (16) extends at least into a slot (44) provided in one of the side walls (8) of the cooler, which slot (44) has a length which corresponds at least to the length of the supporting surface, and in that over at least parts of its length it extends further out through the slot where said drove plate (16) is connected to a drive arrangement for movement back and forth.

14. A cooler (1) according to claim 13, CHARACTERIZED IN THAT said cooler comprises a drive plate (16) on each side.

15. A cooler (1) according to claim 1, CHARACTERIZED IN THAT each drive plate (16) is provided with slits (23) provided at appropriate intervals for absorption of potential thermal expansion.

16. A cooler (1) according to claim 1, CHARACTERIZED IN THAT the scraper elements (14) are formed with a triangular cross-sectional profile having a forward facing surface, a backward facing surface and a downward facing surface, where the forward-facing surface (36*a*) extends at an angle $\alpha$ of between 60° and 90° relative to horizontal, and in that the backward-facing surface (36*b*) extends substantially at an angle $\beta$ of between 20° and 40° relative to horizontal, whereas the downward-facing surface is substantially horizontal.

17. A cooler (1) according to claim 1, CHARACTERIZED IN THAT said cooler further comprises stationary scraper elements (14*a*).

18. A cooler (1) according to claim 1 or 16, CHARACTERIZED IN THAT said cooler is formed without scraper elements at the inlet end.

19. A cooler (1) according to claim 1 or 16, CHARACTERIZED IN THAT said cooler comprises inverted or equal-sided scraper elements at the inlet end.

20. A cooler (1) according to claim 1, CHARACTERIZED IN THAT each of the stationary supporting surfaces (11) comprises a grate which is made up of a number of grate plates (11*a*), each of which being provided with through-going slits or holes for injecting cooling gas through the material from the underlying chamber (13).

21. A cooler (1) according to claim 1, CHARACTERIZED IN THAT each of the stationary supporting surfaces (11) comprises a number of trays which are formed as a rectangular box with bottom, side walls and end walls, said box containing during operation a quantity of the particulate material which is to be cooled, and in that at the bottom of each tray it incorporates air supply means for injecting cooling gas into the material.

22. A cooler (1) according to claim 19 or 21, CHARACTERIZED IN THAT said cooler comprises continuously and automatically operating flow regulators (11*b*) which are fitted in the gas supply duct (11*c*) of each grate plate or tray for regulating the cooling gas flow up through the grate plate or tray.

23. A cooler according to claim 1, wherein the kiln is a rotary kiln for manufacturing cement clinker.

24. A cooler, for cooling particulate material which has been subjected to heat treatment in an industrial kiln, which cooler comprises an inlet, an outlet, end walls, side walls, a bottom and a ceiling, at least one stationary supporting surface for receiving and supporting the material to be cooled, means for injecting cooling gas into the material, as well as a reciprocating scraper system which comprises at least one row of scraper elements which extend transversely across the direction of movement of the material, said elements being moved back and forth over the supporting surface in the direction of movement of the material in order to convey the material forward over the supporting surface, CHARACTERIZED IN THAT each row of the transverse scraper elements is firmly fixed to at least one drive plate oriented in the direction of movement of the material, and in that said at least one plate extends at least across the entire length of the supporting surface, and in that said drive plate extends either through the supporting surface, the ceiling, one of the side walls and/or at least one of the end walls of the cooler, where the drive plate is connected to a drive arrangement for movement back and forth, and further CHARACTERIZED IN THAT the drive plate is substantially vertical, and in that at all times over a part of its length, corresponding to the length of the supporting surface, it extends at least down into a slot which is provided throughout the length of the supporting surface, and in that further over at least parts of its length it extends down through the slot to an underlying chamber in which the drive plate is connected to a drive arrangement for movement back and forth.

25. A cooler according to claim 24, CHARACTERIZED IN THAT at both sides of the drive plate there is a wall element which is fixed to the supporting surface, and in that extending over the entire length of the supporting surface it protrudes slightly less into the cooler than the drive plate, and in that on the upper side of the drive plate and over its entire length a plate element is fitted with said element being designed so that it extends over and beyond the upper side edge of the wall elements.

26. A cooler according to claim 24, CHARACTERIZED IN THAT each row of transverse scraper elements is fixed to at least two substantially parallel drive plates.

27. A cooler according to claim 26, CHARACTERIZED IN THAT the drive arrangement comprises a drive frame which is made up of two longitudinal girders and at least two transverse girders and in that the drive plates are fixed to the longitudinal girders.

28. A cooler according to claim 27, CHARACTERIZED IN THAT each of the longitudinal girders of the drive frame is movably supported at least at two locations by means of rails fixed to the underside of the longitudinal girders, and in that said rails slide in bearings which are fixed to the machine frame at an appropriate distance.

29. A cooler according to claim 28, CHARACTERIZED IN THAT said cooler comprises at least one hydraulic cylinder for moving the drive frame back and forth, said hydraulic cylinder being connected to one of the transverse girders of the drive frame.

30. A cooler according to claim 29, CHARACTERIZED IN THAT said cooler comprises for each row of scraper elements at least one hydraulic cylinder, and in that the hydraulic cylinders can be separately operated.

31. A cooler according to claim 26, CHARACTERIZED IN THAT each scraper element is fixed to the upper side of each drive plate by means of a box-like element which at its side facing the drive plate comprises a cutout section for accommodating the scraper element, and in that on each side of the cut-out section it is formed with an at least downward terminating cavity for accommodating from the upper side of the drive plate upwardly protruding cars which are provided with a through-going hole which during the mounting of the box element is situated on line with a corresponding hole provided in the box element, and in that a wedge is fitted so that it extends through the holes on both sides of the scraper element, and in that each wedge is locked by means of a locking pin which extends at least through the relevant ear and wedge, and in that the scraper element is further restrained in axial direction by means of a pawl which is inserted in the scraper element extending up through a hole in the upward-turning side of the box element.

32. A cooler according to claim 24, CHARACTERIZED IN THAT each scraper element is fixed to the upper side of each drive plate by means of a box-like element which at its side facing the drive plate comprises a cutout section for accommodating the scraper element, and in that on each side of the cut-out section it is formed with an at least downward terminating cavity for accommodating from the upper side of the drive plate upwardly protruding ears which are provided with a through-going hole which during the mounting of the box element is situated on line with a corresponding hole provided in the box element, and in that a wedge is fitted so that it extends through the holes on both sides of the scraper element, and in that each wedge is locked by means of a locking, pin which extends at least through the relevant car and wedge, and in that the scraper element is further restrained in axial direction by means of a pawl which is inserted in the scraper element extending up through a hole in the upward-turning side of the box element.

33. A cooler according to any one of claims 24–32, CHARACTERIZED IN THAT each drive plate has a length which corresponds at least to the length of the supporting surface plus a selected stroke length of the drive plate.

34. A cooler according to claim 33, CHARACTERIZED IN THAT each drive plate extends through an opening provided in the end wall of the cooler, which opening is configured so that it corresponds exactly to the cross-sectional profile of the drive plate and the plate element lying thereon, and in that a pressurized box is fitted on the outer side of the cooler, with the depth of the box corresponding at least to the selected stroke length of the drive plate.

35. A cooler according to claim 24, CHARACTERIZED IN THAT the drive plate is substantially horizontal, and in that at all times over a part of its length, corresponding to the length of the supporting surface, the plate extends at least into a slot provided in one of the side walls of the cooler, which slot has a length which corresponds at least to the length of the supporting surface, and in that over at least parts of its length it extends further out through the slot where it is connected to a drive arrangement for movement back and forth.

36. A cooler according to claim 35, CHARACTERIZED IN THAT said cooler comprises a drive plate on each side.

37. A cooler according to claim 24, CHARACTERIZED IN THAT each drive plate is provided with slits provided at appropriate intervals for absorption of potential thermal expansion.

38. A cooler according to claim 24, CHARACTERIZED IN THAT the scraper elements are formed with a triangular cross-sectional profile having a forward-facing surface, a backward-facing face and a downward-facing surface, where the forward-facing surface extends at an angle $\alpha$ of between 60° and 90° relative to horizontal, and in that the backward-facing surface extends substantially at an angle $\beta$ of between 20° and 40° relative to horizontal, whereas the downward-facing surface is substantially horizontal.

39. A cooler according to claim 24, CHARACTERIZED IN THAT said cooler further comprises stationary scraper elements.

40. A cooler according to claim 24 or 38, CHARACTERIZED IN THAT said cooler is formed without scraper elements at the inlet end.

41. A cooler according to claim 24 or 38, CHARACTERIZED IN THAT said cooler comprises inverted or equal-sided scraper elements at the inlet end.

42. A cooler according to claim 24, CHARACTERIZED IN THAT each of the stationary supporting surfaces comprises a grate which is made up of a number of grate plates, each of which being provided with through-going slits or holes for injecting cooling gas through the material from the underlying chamber.

43. A cooler according to claim 24, CHARACTERIZED IN THAT each of the stationary supporting surfaces comprises a number of trays which are formed as a rectangular box with bottom, side walls and end walls, said box containing during operation a quantity of the particulate material which is to be cooled, and in that at the bottom of each tray it incorporates air supply means for injecting cooling gas into the material.

44. A cooler according to claim 40 or 41, CHARACTERIZED IN THAT said cooler comprises continuously and automatically operating flow regulators which are fitted in the gas supply duct of each grate plate or tray for regulating the cooling gas flow up through the grate plate or tray.

45. A cooler according to claim 24, wherein the kiln is a rotary kiln for manufacturing cement clinker.

46. A cooler, for cooling particulate material which has been subjected to heat treatment in an industrial kiln, which cooler comprises an inlet, an outlet, end walls, side walls, a bottom and a ceiling, at least one stationary supporting surface for receiving and supporting the material to be cooled, means for injecting cooling gas into the material, as well as a reciprocating scraper system which comprises a number of rows of scraper elements which extend transversely across the direction of movement of the material, said elements being moved back and forth over the supporting surface in the direction of movement of the material in order to convey the material forward over the supporting surface, CHARACTERIZED IN THAT each row of the transverse scraper elements is firmly fixed to at least one drive plate oriented in the direction of movement of the material, and in that said at least one plate extends at least across the entire length of the supporting surface, and in that said drive plate extends either through the supporting surface, the ceiling, one of the side walls and/or at least one of the end walls of the cooler, where the drive plate is connected to a drive arrangement for movement back and forth, and where at least a portion of the drive plate is positioned such that it will move back and forth along its own track within the material to be cooled.

47. A cooler according to claim 46, CHARACTERIZED IN THAT the drive plate is substantially vertical, and in that at all times over a part of its length, corresponding to the length of the supporting surface, it extends at least down into a slot which is provided throughout the length of the supporting surface, and in that further over at least parts of its length it extends down through the slot to an underlying chamber in which the drive plate is connected to a drive arrangement for movement back and forth.

48. A cooler according to claim 47, CHARACTERIZED IN THAT at both sides of the drive plate there is a wall element which is fixed to the supporting surface, and in that extending over the entire length of the supporting surface it protrudes slightly less into the cooler than the drive plate, and in that on the upper side of the drive plate and over its entire length a plate clement is fitted with said element being designed so that it extends over and beyond the upper side edge of the wall elements.

49. A cooler according to claim 47, CHARACTERIZED IN THAT each row of transverse scraper elements is fixed to at least two substantially parallel drive plates.

50. A cooler according to claim 49, CHARACTERIZED IN THAT the drive arrangement comprises a drive frame which is made up of two longitudinal girders and at least two transverse girders and in that the drive plates are fixed to the longitudinal girders.

51. A cooler according to claim 50, CHARACTERIZED IN THAT each of the longitudinal girders of the drive frame is movably supported at least at two locations by means of rails fixed to the underside of the longitudinal girders, and in that said rails slide in bearings which arc fixed to the machine frame at an appropriate distance.

52. A cooler according to claim 51, CHARACTERIZED IN THAT said cooler comprises at least one hydraulic cylinder for moving the drive frame back and forth, said hydraulic cylinder being connected to one of the transverse girders of the drive frame.

53. A cooler according to claim 52, CHARACTERIZED IN THAT said cooler comprises for each row of scraper elements at least one hydraulic cylinder, and in that the hydraulic cylinders can be separately operated.

54. A cooler according to claim 49, CHARACTERIZED IN THAT each scraper element is fixed to the upper side of each drive plate by means of a box-like element which at its side facing the drive plate comprises a cutout section for accommodating the scraper element, and in that on each side of the cut-out section it is formed with an at least downward terminating cavity for accommodating from the upper side of the drive plate upwardly protruding ears which are provided with a through-going hole which during the mounting of the box element is situated on line with a corresponding hole provided in the box element, and in that a wedge is fitted so that it extends through the holes on both sides of the scraper element, and in that each wedge is locked by means of a locking pin which extends at least through the relevant ear and wedge, and in that the scraper element is further restrained in axial direction by means of a pawl which is inserted in the scraper element extending up through a hole in the upward-turning side of the box element.

55. A cooler according to claim 47, CHARACTERIZED IN THAT each scraper clement is fixed to the upper side of each drive plate by means of a box-like element which at its side facing the drive plate comprises a cutout section for accommodating the scraper element, and in that on each side of the cut-out section it is formed with an at least downward terminating cavity for accommodating from the upper side of the drive plate upwardly protruding ears which are provided with a through-going hole which during the mounting of the box clement is situated on line with a corresponding hole provided in the box clement, and in that a wedge is fitted so that it extends through the holes on both sides of the scraper element, and in that each wedge is locked by means of a locking pin which extends at least through the relevant ear and wedge, and in that the scraper element is further restrained in axial direction by means of a pawl which is inserted in the scraper element extending up through a hole in the upward-turning side of the box element.

56. A cooler according to claims 46–55, CHARACTERIZED IN THAT each drive plate has a length which corresponds at least to the length of the supporting surface plus a selected stroke length of the drive plate.

57. A cooler according to claim 56, CHARACTERIZED IN THAT each drive plate extends through an opening provided in the end wall of the cooler, which opening is configured so that it corresponds exactly to the cross-sectional profile of the drive plate and the plate element lying thereon, and in that a pressurized box is fitted on the outer side of the cooler, with the depth of the box corresponding at least to the selected stroke length of the drive plate.

58. A cooler according to claim 46, CHARACTERIZED IN THAT the drive plate is substantially horizontal, and in that at all times over a part of its length, corresponding to the length of the supporting surface, the plate extends at least into a slot provided in one of the side walls of the cooler, which slot has a length which corresponds at least to the length of the supporting surface, and in that over at least parts of its length it extends further out through the slot where it is connected to a drive arrangement for movement back and forth.

59. A cooler according to claim 58, CHARACTERIZED IN THAT said cooler comprises a drive plate on each side.

60. A cooler according to claim 46, CHARACTERIZED IN THAT each drive plate is provided with slits provided at appropriate intervals for absorption of potential thermal expansion.

61. A cooler according to claim 46, CHARACTERIZED IN THAT the scraper elements are formed with a triangular cross-sectional profile having a forward-facing surface, a backward-facing surface and a down-ward facing surface, where the forward-facing surface extends at an angle $\alpha$ of between 60° and 90° relative to horizontal, and in that the backward-facing surface extends substantially at an angle $\beta$ of between 20° and 40° relative to horizontal, whereas the downward-facing surface is substantially horizontal.

62. A cooler according to claim 46, CHARACTERIZED IN THAT said cooler further comprises stationary scraper elements.

63. A cooler according to claim 46 or 61, CHARACTERIZED IN THAT said cooler is formed without scraper elements at the inlet end.

64. A cooler according to claim 46 or 61, CHARACTERIZED IN THAT said cooler comprises inverted or equal-sided scraper elements at the inlet end.

65. A cooler according to claim 46, CHARACTERIZED IN THAT each of the stationary supporting surfaces comprises a grate which is made up of a number of grate plates, each of which being provided with through-going slits or holes for injecting cooling gas through the material from the underlying chamber.

66. A cooler according to claim 46, CHARACTERIZED IN THAT each of the stationary supporting surfaces comprises a number of trays which are formed as a rectangular box with bottom, side walls and end walls, said box containing during operation a quantity of the particulate material which is to be cooled, and in that at the bottom of each tray it incorporates air supply means for injecting cooling gas into the material.

67. A cooler according to claim 65 or 66, CHARACTERIZED IN THAT said cooler comprises continuously and automatically operating flow regulators which are fitted in the gas supply duct of each grate plate or tray for regulating the cooling gas flow up through the grate plate or tray.

68. A cooler according to claim 46, wherein the kiln is a rotary kiln for manufacturing cement clinker.

* * * * *